United States Patent [19]

Schwartz

[11] 4,326,761

[45] Apr. 27, 1982

[54] KEY AND LOCK CORE COMBINATION

[76] Inventor: Samuel Schwartz, Box 96A, Bechtelsville, Pa. 19505

[21] Appl. No.: 101,824

[22] Filed: Dec. 10, 1979

[51] Int. Cl.[3] ..... B65D 5/50; A47F 5/08; A47B 67/02

[52] U.S. Cl. ..... 312/326; 312/245; 211/13; 211/72; 211/88; 206/45.14

[58] Field of Search ..... 312/326, 206, 245, 257 SM, 312/204, DIG. 33; 211/13, 60 A, 87, 88, 72; 206/303, 45.14; 248/111, 301, 314

[56] References Cited

U.S. PATENT DOCUMENTS

| | | | |
|---|---|---|---|
| 184,904 | 11/1876 | Rallo | 312/245 |
| 666,941 | 1/1901 | Streit | 206/45.14 |
| 997,154 | 7/1911 | Slaymaker et al. | 211/13 |
| 1,226,231 | 5/1917 | Mack | 211/88 |
| 1,551,139 | 8/1925 | Dietsche, Jr. | 211/72 |
| 1,742,542 | 1/1930 | Howell | 211/13 |
| 1,896,677 | 2/1933 | Myers | 206/45.14 |
| 1,948,738 | 2/1934 | Thayer | 312/326 |
| 2,347,035 | 4/1944 | Douglas | 211/13 |
| 2,477,274 | 7/1949 | Trecek | 206/45.14 |
| 2,805,777 | 9/1957 | Larson | 211/87 |
| 2,889,050 | 6/1959 | Modrey | 211/13 |

FOREIGN PATENT DOCUMENTS

| | | | |
|---|---|---|---|
| 465074 | 5/1950 | Canada | 211/60 A |
| 819995 | 9/1959 | United Kingdom | 206/45.14 |

*Primary Examiner*—Victor N. Sakran
*Attorney, Agent, or Firm*—Ruth Moyerman

[57] ABSTRACT

A key and lock core container suitable for a multiplicity of cores is disclosed.

The key and lock core container of this invention contains one or more rigid frames containing a series of individual lock core holders and key hooks. The frame is intended to be vertically mounted on a wall or in a wall hung cabinet. The lock core holders are large enough to contain only the cores and are provided, where needed, with a cutout portion through which a detent portion of the core may extend. Associated with each core holder is a hook means on which the key(s) of that particular core may be suspended.

2 Claims, 5 Drawing Figures

KEY AND LOCK CORE COMBINATION

BACKGROUND OF THE INVENTION

1. Field of the Invention

This invention relates to locks and more particularly to key and lock holders.

2. Description of the Prior Art

Today's modern buildings whether they are apartments, offices, colleges or hospitals, etc. have an ever growing need for large numbers of locked areas. Furthermore, these locks require periodic changing of the keying systems to enable security to be maintained. One of the ways in which re-keying is accomplished today is by the use of what is called an interchangeable core. That is to say, the re-keying is accomplished by utilizing a master key to remove the entire lock core and to insert therein a new core adapted to be utilized with an accompanying set of keys. Thus, any system which uses the changeable core must include a method for the orderly arrangement and storage of a multitude of cores and their accompanying keys.

A system in current use employs a cabinet with partitioned drawers for the purpose of segregating the individual cores and their keys. This cabinet system is bulky and space consuming and the cabinet is expensive to produce. Furthermore, since at least one of the key and core lock combinations on the market today utilizes a detent portion on the core itself, the cabinet method of storage requires an inordinately large space to be provided to accommodate this particular core.

Cabinets and panels which contain a multiplicity of hooks for containing keys are also known and have been utilized for many years. However, no system is known for a combination of key and core lock containers to be stored together so as to provide order in storage, simplicity of use and convenience of maintenance and versatility to allow ready adoption to changing market needs.

There is, therefore, a need for a new storage and core control system which is less expensive to produce, easier to use, is attractive in appearance, is adaptable to a small area and can be easily updated for new core sizes and shapes.

SUMMARY OF THE INVENTION

The aforementioned prior art problems are solved by the key and lock core container of this invention.

The key and lock core container of this invention contains one or more rigid frames containing a series of individual lock core holders and key hooks. The frame is intended to be vertically mounted on a wall or in a wall hung cabinet. The lock core holders are large enough to contain only the cores and are provided, where needed, with a cutout portion through which a detent portion of the core may extend. Associated with each core holder is a hook means on which the key(s) of that particular core may be suspended.

In the preferred embodiment, a single sheet of material such as steel is bent intermittent its length into a series of right angle bends to form an elongated pocket portion. A series of holes in one face of the pocket portion provides an opening into which individual cores may be inserted. The shape of the core holders is generally parallelpipedal (although two walls are omitted and/or two walls have openings). A back board on which the hook means for the keys is attached is provided by the non-bent portion of the frame.

Alternate embodiments include having the back board hingeably attached at a point on the frame so that it forms a cover for the core holders. Other embodiments include having the core holders themselves mounted in a direction opposite that of the hooks. This latter arrangement is particularly suitable where the core holders are intended to be recessed.

The frame may be mounted on the wall "as is" but is more conveniently and safely mounted within a cabinet where the entire system may be locked itself for security purposes. Furthermore, a series of individual frames may be contained within a single cabinet, thereby greatly increasing the number of cores available.

It is, therefore, an object of this invention to provide a compact and easy to use storage container for key and core control systems.

It is yet another object of this invention to provide the aforementioned key and core holder storage system as a vertical container.

It is yet another object of this invention to provide a key and core holder storage system which is versatile, can be adapted to a variety of office arrangements and can readily be updated to accommodate new core sizes and types.

It is yet another object of this invention to accomplish the foregoing by the provision of an attractive yet unobtrusive article of manufacture.

These and other objects will be more fully ascertainable to one skilled in the art from the consideration of the figures, descriptive text and exemplary embodiments.

DESCRIPTION OF THE PREFERRED EMBODIMENT(S)

Figure 1:
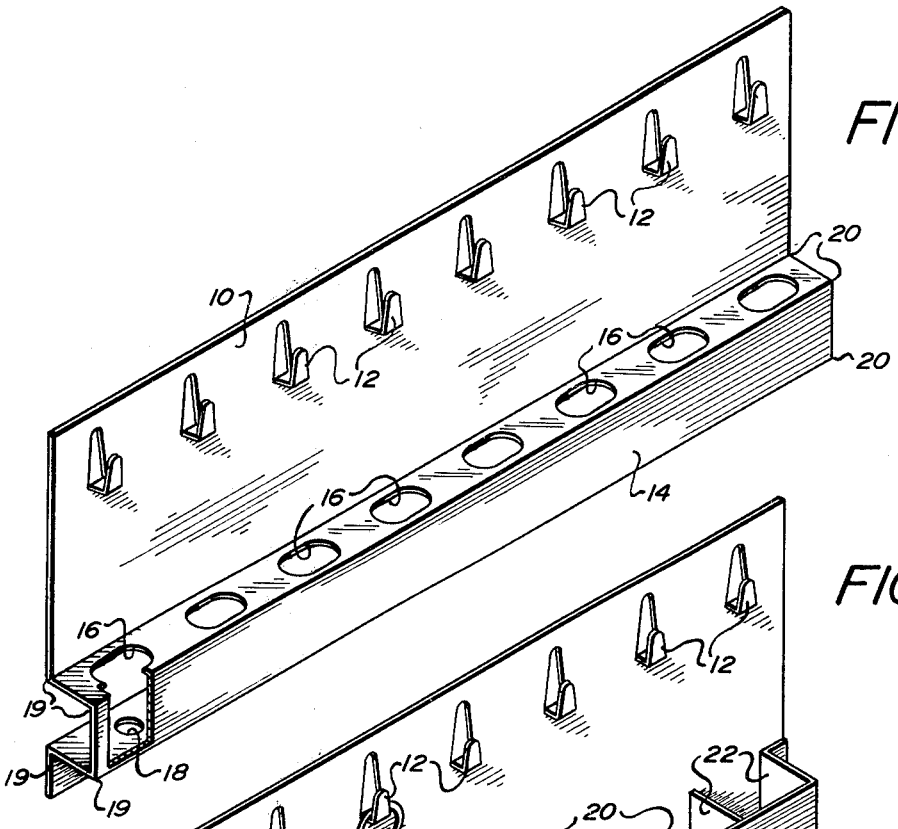
FIG. 1 illustrates an elevation of the preferred key and lock core of this invention.

Referring now to the drawings and more particularly to FIG. 1, the key and lock core container of this invention is shown including back board 10. Back board 10 is shown as a generally planar piece of rigid material, preferably steel. Mounted on back board 10 is a series of hook means 12 which, in the illustration in the Figure are formed by the cutting out, in the shape of a V, of part of back board 10. The hook means is formed by bending the cutout forward into a detent-like hook. Below hook means 12 a single series of lock core holders 14 is shown. The series is made up of individual lock core holders which, in the embodiment illustrated in FIG. 1 are formed, or rather defined, by openings 16. The embodiment illustrated in FIG. 1 includes eight such openings through which an individual lock core holder may be inserted. Also illustrated, by cut-away, is lock core holder opening 18. Lock core holder opening 18 is for the purpose of allowing a detent portion of the lock core to pass through opening 18 to conserve room in the lock core holder. The lock core holder shown in FIG. 1 is preferably formed by a single, continuous sheet of material which, through a series of right angle bends 19, forms the entire container. Thus, the lock core holder series, while generally parallelpipedal, includes no compartment sides between the individual lock core holders. Also in the embodiment illustrated there is no back wall running the length of the core holder. The back is provided by, for example, a wall upon which the container may be mounted. It should be appreciated that fabrication from a continuous sheet in this Figure is not mandatory and the key and core lock container may be formed by joining individual components.

Figure 2:
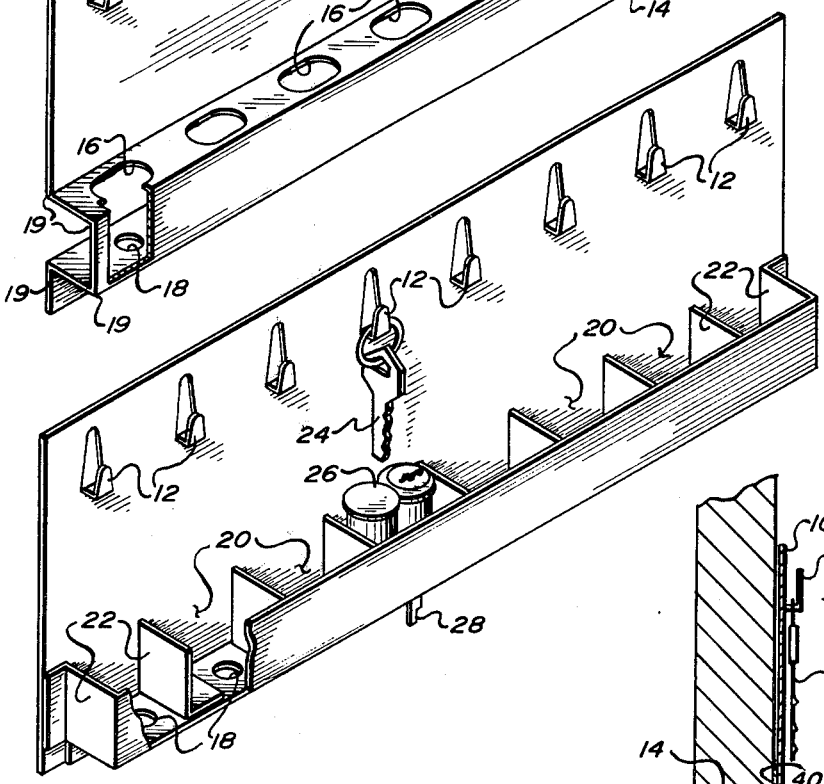
FIG. 2 shows an alternate embodiment of the key and lock core of this invention.

Referring now to FIG. 2, a second embodiment is shown. In the embodiment illustrated in FIG. 2, back board 10 extends downward to form a back wall 20 for the lock core container. In FIG. 2, lock core holder 14 includes side walls 22 and may or may not contain openings 18 depending on whether a lock core with a detent portion is intended for storage therein. In the illustration in FIG. 2, key 24 and lock core 26 are shown to illustrate the lock core container utility and how the key and lock cores are positioned. Lock core 26 in FIG. 2 includes detent 28 which is intended to pass through openings 18, extending downward therefrom.

Figure 3:
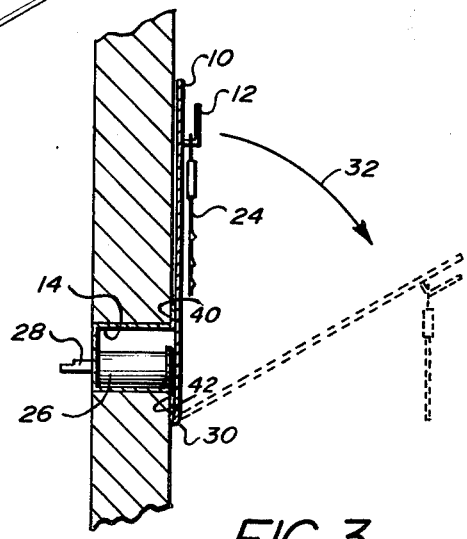
FIG. 3 shows a vertical cross section of yet another embodiment of this invention.

Referring now to FIG. 3, a vertical cross section is shown of yet another embodiment of the lock core container of this invention. In FIG. 3, back board 10 extends downward all the way to hinge 30 where it connects to lower lip 42, thereby forming a front closing for lock core holder 14. This front closing is illustrated in FIG. 3 in phantom where arrow 32 indicates the direction back board 10 may be moved thereby exposing core lock holder 14. Lock core holder 14 itself includes both upper lip 40 and lower lip 42. It should be noted that in the variation shown in FIG. 3, hook means 12 and core holder 14 appear on generally opposing faces of back board 10. Furthermore, lock core 26 is mounted within lock core holder 14 horizontally. This is in contrast to the views in FIGS. 1 and 2 in which the lock core was positioned vertically.

Figure 4:
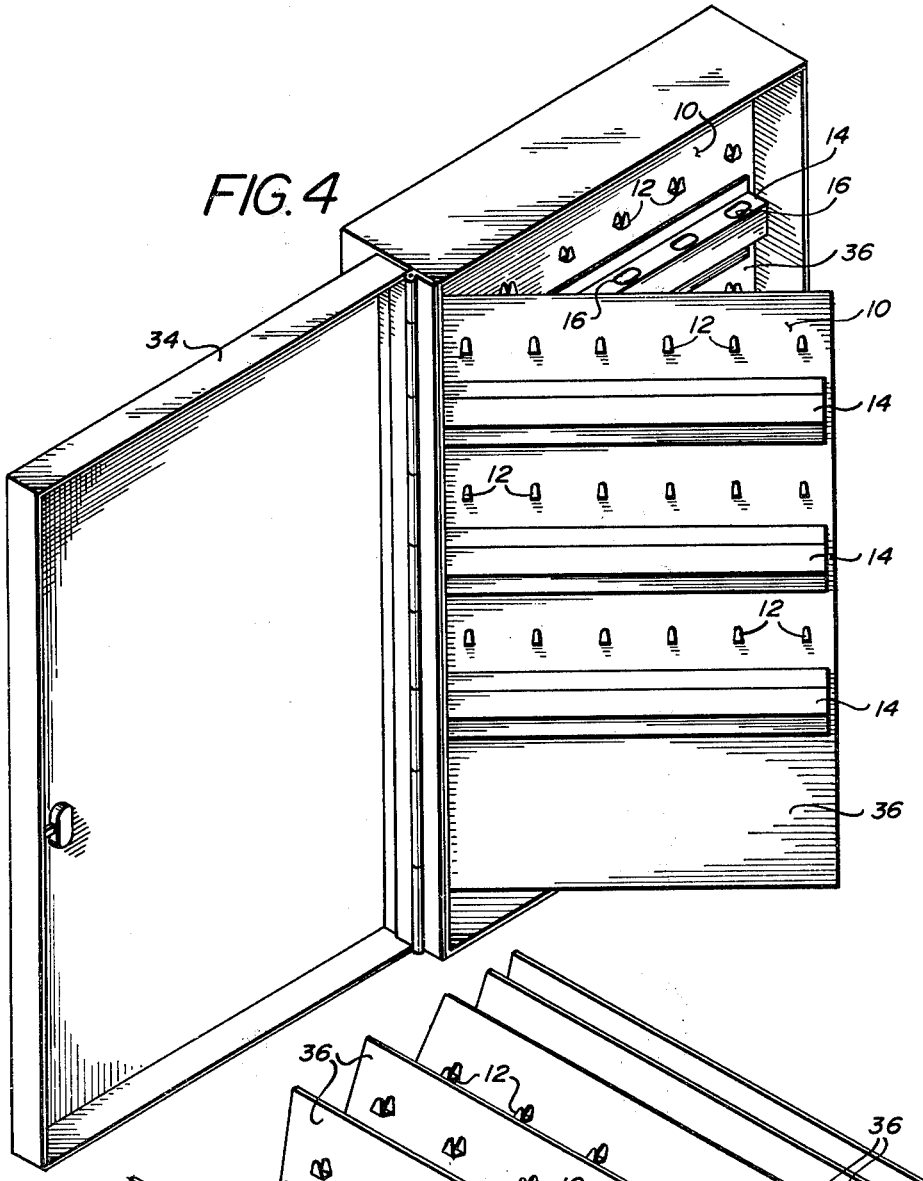
FIG. 4 shows the key and core lock of this invention in a cabinet mount.

Referring now to FIG. 4, cabinet 34 is shown including several panels 36, each of which contains a series of core lock holders 14. Thus, core lock holders 14 are adaptable to any type of mounting such as the wall hanging type illustrated in FIGS. 1, 2 and 3, and the vertical cabinet as illustrated in FIG. 4.

Figure 5:
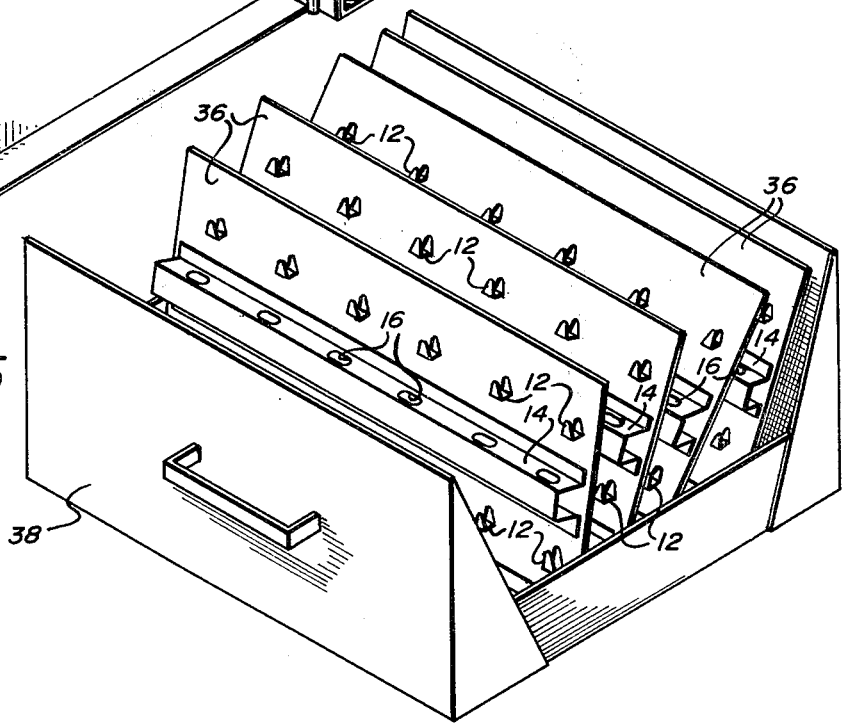
FIG. 5 shows the key and lock core of this invention in a drawer mount.

Yet another type of mounting for the lock core holders of this invention is shown in FIG. 5 in which drawer 38 is illustrated. Drawer 38 may be of a type suitable for insertion in a conventional file cabinet or other storage. Drawer 38 contains a series of panels 36, each containing a series of lock core holders 14. The panels easily slide into the drawer through grooves in the side of the drawer (not shown).

There are many variations which may be practiced within the scope of this invention. As has been illustrated, there are several ways in which core holders may be formed and the word parallelpipedal is not intended to be limiting. FIG. 1, for example, illustrates core holders without individual sides and wherein the back portion is formed by an external wall. The core holders may have open tops or they may have tops which include cutouts of an appropriate size to receive the core holder. The core holders may or may not require a further opening to allow a detent portion or other similar irregularities of shape to be accommodated.

Hook means 12, while preferably formed as a cutout portion of back board 10, is not limited to this configuration. Any hook or hooking means which serves the purpose of providing a receiver for a key is satisfactory. Hook means 12 may also be located on other portions of the lock and core holder other than those illustrated. For example, the hook means may be located separately within the cabinet or on another panel. Also, core holder 14 may be enlarged to accommodate both core holder and key and thus the hook means may be eliminated.

The preferred material of construction of the core lock container of this invention is metal or a rigid, nondeformable plastic or other material which provides sufficient body to be conveniently utilized.

The arrangement and size and number of lock core holders may be expanded, changed or interchanged to accommodate the needs of the individual user. Coding cards or other indicia of identification may also be associated with the key and lock core container to facilitate their use.

Thus, the invention as shown and described provides an efficient, convenient and inexpensive means for storing heretofore unknown. Security, interchangeability, ready access, convenience and ease of keeping up with the system all result from the disclosed container. A minimum of space is required and the entire container fits unobtrusively in an office drawer, cabinet or can be wall mounted, either recessed or flush.

Having thus described my invention, it is not intended that such description be limiting, but rather that the invention be limited only by a reasonable interpretation of the claims.

What is claimed is:

1. A compartmental key and lock core container comprising, as a rigid frame:

(a) a continuous sheet of rigid material containing a series of four right angle bends intermittent its length to form thereby an elongated pocket portion, said pocket containing a first upper lip portion and a second lower lip portion at its edges, said pocket portion being of a size and shape to accommodate a row of lock cores; and, (b) a planar back board of a dimensional size so that it totally overlaps said pocket portion, said back board being hingedly attached at its lower edge to said pocket portion lower lip edge.

2. The key and lock core container of claim 1 including additionally hook means on said back board outer face, one for each lock core holder, to allow a key or the like to be suspended thereon.

* * * * *